United States Patent [19]

Inoue

[11] 4,272,918

[45] Jun. 16, 1981

[54] MULTI-POSITION REMOTE CONTROLLING DEVICE FOR TOYS

[75] Inventor: Tsutomu Inoue, Ichikawa, Japan

[73] Assignee: Takara Co., Ltd., Tokyo, Japan

[21] Appl. No.: 21,639

[22] Filed: Mar. 19, 1979

[30] Foreign Application Priority Data

Mar. 30, 1978 [JP] Japan ..... 53-41442[U]

[51] Int. Cl.[3] ..... A63H 11/00

[52] U.S. Cl. ..... 46/266; 46/248; 46/256

[58] Field of Search ..... 46/253, 254, 256, 264, 46/265, 266, 248, 210, 251, 39, 269; 74/340, 342, 325, 50, 25, 26

[56] References Cited

U.S. PATENT DOCUMENTS

| | | | |
|---|---|---|---|
| 1,880,138 | 9/1932 | Hubl | 46/266 X |
| 2,633,669 | 4/1953 | Churus | 46/264 |
| 3,014,311 | 12/1961 | Ernst | 46/253 |
| 3,103,762 | 9/1963 | Glass et al. | 46/264 X |
| 3,383,795 | 5/1968 | Ryan et al. | 46/264 |
| 4,085,542 | 4/1978 | Mitamura | 46/256 |

FOREIGN PATENT DOCUMENTS

| | | | |
|---|---|---|---|
| 570048 | 8/1958 | Belgium | 46/269 |
| 1304969 | 12/1962 | France | 46/253 |

*Primary Examiner*—Gene Mancene
*Assistant Examiner*—Mickey Yu
*Attorney, Agent, or Firm*—Jackson, Jones & Price

[57] ABSTRACT

A control device adapted for remotely controlling a plurality of moving appendages or functions of a toy or a small machine, is disclosed. The toy includes a drive motor which provides power to rotate a drive gear. A control gear is pivotably mounted within the toy. It is permanently meshed with the drive gear and is laterally displaceable relative thereto. A plurality of output gears are mounted in the toy in positions wherein the control gear is capable of selectively meshing with each output gear dependent upon the positioning of the control gear relative to the drive gear. Each output gear drives a different appendage or function of the toy. A control motor which is actuable at the option of a player through a suitable remote control device, is provided in the toy. The control motor rotates a cam which laterally moves a cam follower connecting piece. The cam follower connecting piece is operatively connected to the control gear and changes its positioning relative to the drive gear whenever the control motor is in operation. Thus the several moving appendages or functions of the toy may be selectively actuated by the player through time dependent actuation of the control motor.

17 Claims, 6 Drawing Figures

FIG. 4
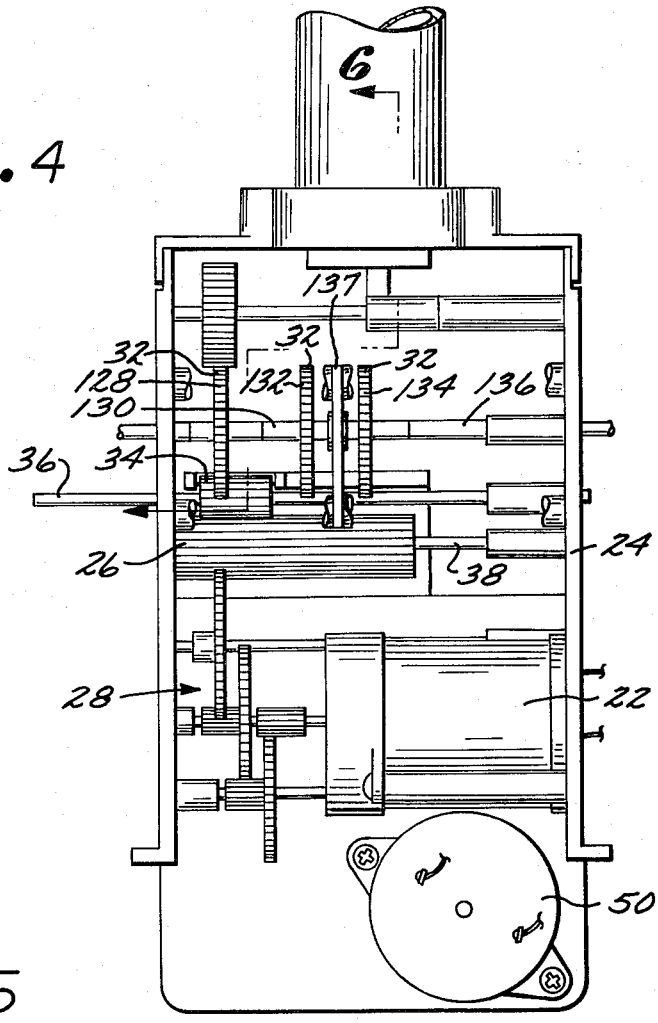
FIG. 5
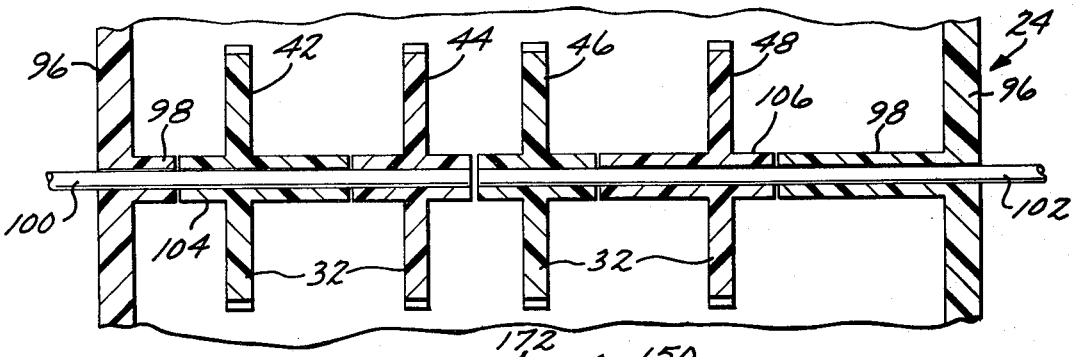
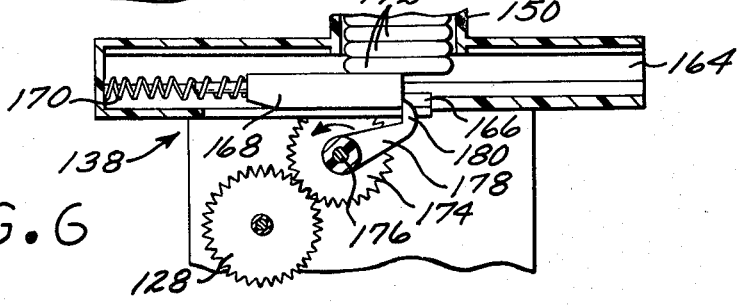
FIG. 6

MULTI-POSITION REMOTE CONTROLLING DEVICE FOR TOYS

BACKGROUND OF THE INVENTION

1. Field of the Invention

The present invention is directed to a device for controlling moving parts or functions of a toy or a small machine and the like, and more particularly to a device for remotely controlling a plurality of moving parts of a toy.

2. Brief Description of the Prior Art

The prior art is well aware of small machines and toys which provide more than one moving function to be selectively actuated by an operator. More particularly, the prior art is aware of toys where component parts such as driving wheels, propellers and other moving appendages may be selectively turned off-and-on by a player.

In some toys of the prior art, selective actuation of the several moving parts is accomplished by a simple manipulation of on-and-off switches. In some other toys of the prior art, selective actuation of the moving parts is accomplished by remote control. These remotely controlled toys usually incorporate a radio signal receiving assembly which is actuated upon receipt of appropriate radio commands sent by the player. Alternatively a flexible cable may be provided through which a player opens or closes various electric circuits which drive the several moving parts of the toy.

It may be readily appreciated by those skilled in the toy art, that a toy assembly having a plurality of conventional, radio controlled moving parts is relatively expensive to manufacture. On the other hand, remote control of a toy through a flexible cable does not generally provide a large degree of versatility. In light of the foregoing it is readily apparent that there is still a need in the prior art for an improved device by which a plurality of moving functions of a toy or small machine may be selectively and remotely controlled.

SUMMARY OF THE INVENTION

It is an object of the present invention to provide an improved control device for a toy or small machine and the like having a plurality of moving functions.

It is a further object of the present invention to provide a remote control device for a small machine, toy or the like which may be actuated by electromagnetic waves, sound waves or electric signals transmitted through a cable.

It is still a further object of the present invention to provide a remote control device for a small machine, toy or the like which is adapted for selective actuation of any one of a plurality of moving functions of the small machine or toy at the option of an operator.

These and other objects and advantages are attained by a device having a drive motor and a control motor both of which are incorporated in a small machine or toy. The machine or toy has a plurality of moving functions or appendages which are energized by the drive motor through a drive gear. A control gear is movably positioned relative to the drive gear in such a manner that the control gear engages the drive gear in a plurality of subjectively selected operating positions. A plurality of output gears are fixedly positioned relative to the drive gear. Each of the output gears drives one of the moving functions or appendages. In each of its subjectively selected operative positions the control gear engages, in addition to the drive gear, also one of the output gears and therefore drives the engaged output gear.

A cam member driven by the control motor drives a cam follower which engages and moves the control gear to place it in-and-out of the several operative positions. The control motor is actuated by a signal receiving assembly in response to a signal sent by an operator. The signal is sent through a signal sending assembly which may be adapted for sending radio, sound or electric signals.

The features of the present invention which are believed to be novel can be best understood, together with further objects and advantages, by reference to the following description taken in connection with the accompanying drawings.

BRIEF DESCRIPTION OF THE DRAWINGS

FIG. 4 is a plan partial view of the toy robot, the view partially showing the second preferred embodiment of the control device of the present invention, a portion of a control device housing being broken away;

FIG. 5 is a cross sectional view of an output gear mounting assembly of the first preferred embodiment of the control device of the present invention, the cross section being taken at lines 5—5 of FIG. 2, and FIG. 6 is a cross sectional view showing a toy projectile ejecting assembly of the toy robot, the cross section being taken at lines 6—6 of FIG. 4.

DESCRIPTION OF THE PREFERRED EMBODIMENT

The following specification taken in conjunction with the drawings sets forth the preferred embodiment of the present invention in such a manner that any person skilled in the mechanical and toy manufacturing arts can use the invention. The embodiments of the invention disclosed herein are the best modes contemplated by the inventor for carrying out his invention in a commercial environment, though it should be understood that various modifications can be accomplished within the parameters of the present invention.

Figure 1:
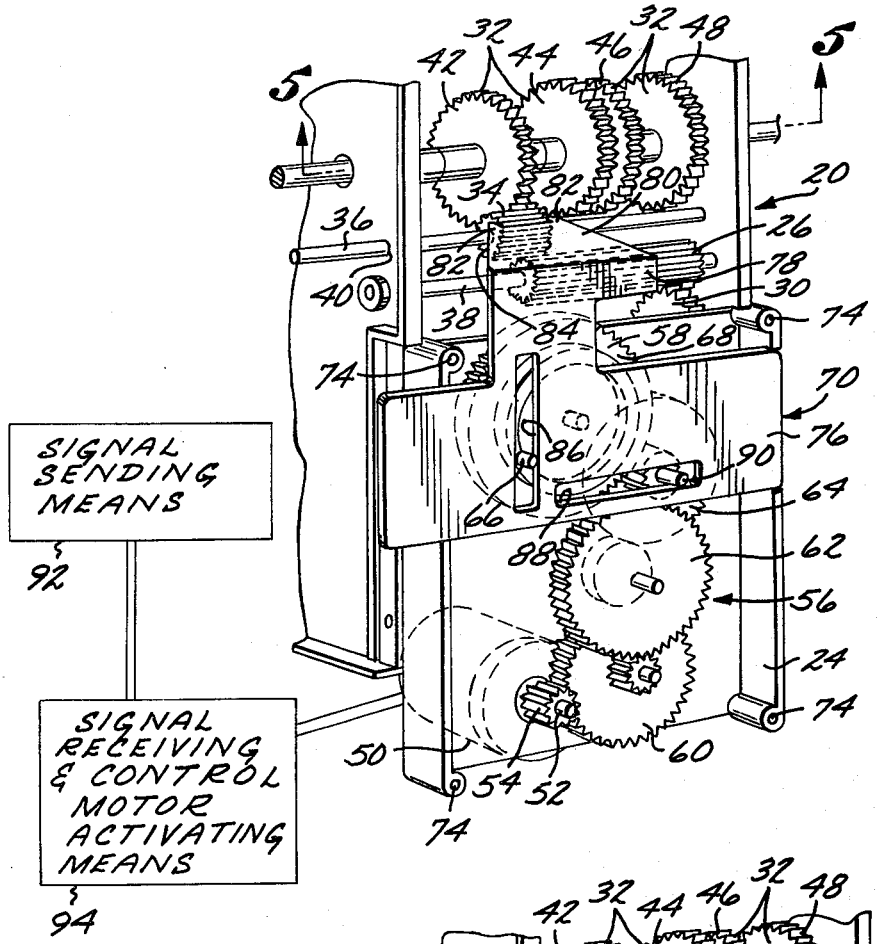
FIG. 1 is a perspective view showing a first state of operation of a first specific embodiment of the control device of the present invention.
Figure 2:
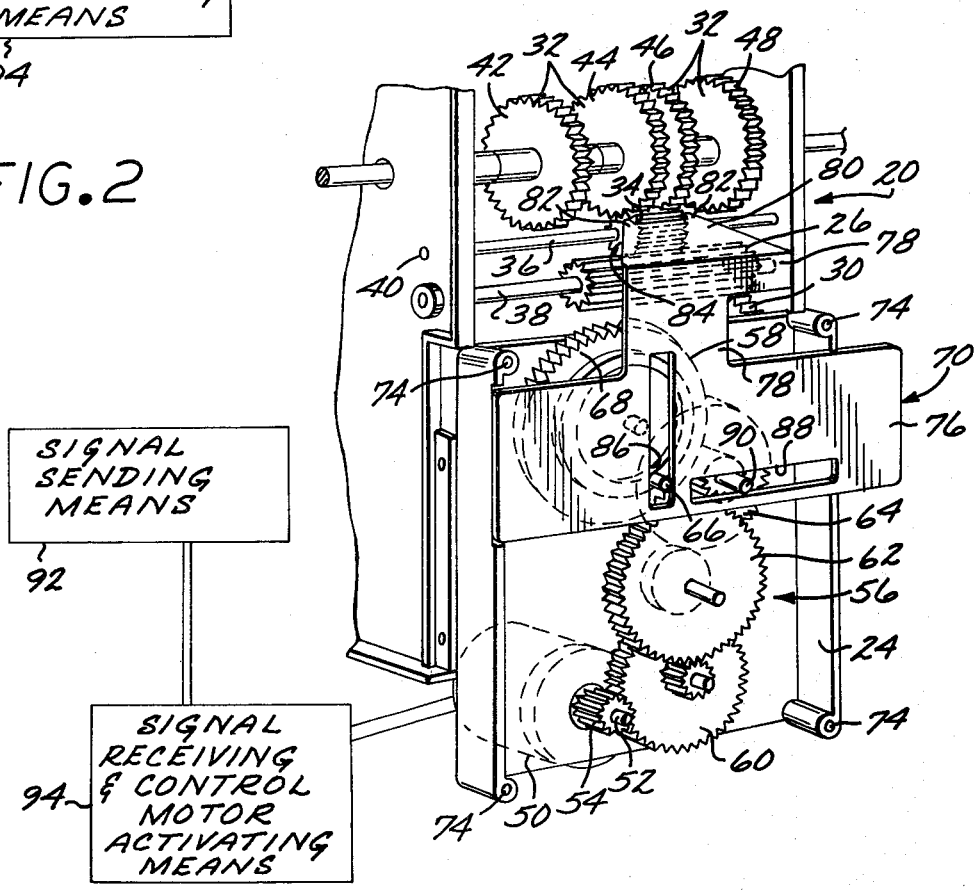
FIG. 2 is a perspective view showing a second state of operation of the first preferred embodiment of the control device of the present invention.

Referring now to FIGS. 1 and 2, a first preferred embodiment of the control device 20 of the present invention is disclosed in detail. It should be understood at the outset that although the control device 20 disclosed herein is particularly well adapted for controlling several moving functions or appendages of a toy, it may also be adapted for use in various small machines such as small appliances and the like. Accordingly, references made hereinafter to a toy in which the control device 20 is incorporated should be construed to include small machines and the like.

The control device 20 together with an electric drive motor 22 is mounted within a housing 24. The drive motor 22 drives a drive gear 26 through the intermediacy of a first reducing gear assembly 28. Although a last gear 30 of the first reducing gear assembly 28 is shown on FIGS. 1 and 2, the entire first reducing gear assembly 28 and the drive motor 22 are not discernible on these figures.

The drive motor 22 of the first preferred embodiment is a relatively small electric motor which is customarily used for driving toys and like devices. It is turned on-and-off by a suitable switch (not shown) located on the outside of the housing (not shown) of the toy. The drive gear 26 is an elongated pinion gear which is fixedly but rotatably mounted within the housing 24. As is shown on FIGS. 1 and 2, the drive gear 26 is in permanent engagement with the first reducing gear assembly 28 and therefore with the drive motor 22. Thus, when the drive motor 22 is energized with current the drive gear 26 rotates regardless of a particular operational status of the control device 20.

The several moving functions or appendages of the toy utilize the drive motor 22 as their source of power. As it is elaborated below, these moving functions may be selectively actuated by an operator or player through the use of the control device 20 of the present invention. Examples of the moving appendages or functions include rotation of wheels (not shown), rotating motion of various appendages, operation of a sound making assembly, and operation of a toy projectile launcher. Generally speaking, a plurality of moving appendages may be connected to and energized by the drive motor 22. Although none of these moving functions are specifically described here in connection with the description of the first preferred embodiment of the present invention, these functions or appendages are briefly described below together with a description of the second preferred embodiment of the control device of the present invention.

Each of the moving functions or appendages energized by the drive motor 22 is directly powered by one of the four output gears 32 shown on FIGS. 1 and 2. Each ooutput gear 32 is fixedly but rotatably mounted within the housing 24 in such a manner that each of them may rotate independently of the other. The independent mounting of the output gears 32 is described in detail below after a detailed description of the control device 20. The output gears 32 are mounted parallel relative to one another and are spaced at a predetermined distance from the drive gear 26 so that none of the output gears 32 are meshed directly with the drive gear 26.

Still referring to FIGS. 1 and 2, a control gear 34 which is disposed between the output gears 32 and the drive gear 26, is disclosed. The control gear 34, like the drive gear 26, is also an elongated pinion gear, and is configured to mesh with the drive gear 26. The control gear 34, however, is shorter than the drive gear 26 and is movably mounted within the housing 24 relative to the drive gear 26. In the first preferred embodiment of the control device 20 of the present invention an axle 36 of the control gear 34 is disposed parallel with an axle 38 of the drive gear 26. The control gear 34 is fixedly mounted to its axle 36, and the axle 36 itself is rotatably mounted within the housing 24. The axle 36 is also capable of lateral displacement relative to the housing 24. In a control device 20 designed for a relatively light duty application, such as the control device 20 disclosed here, the axle 36 is simply held in suitable aligned apertures 40 located in the housing 24. It is readily apparent from this structure that the axle 36 may freely rotate and may also laterally move relative to the housing 24.

The control gear 34 is permanently meshed with the drive gear 26, although the structure of alternative embodiments of the control device 20 of the present invention may provide for a sufficiently large lateral displacement of the control gear 34 whereby the control gear 34 may even be moved out of meshing position with the drive gear 26.

The overall length of the control gear 34 and the positioning of the output gears 32 is selected in such a manner that the control gear 34 may occupy at least one position wherein it meshes only with single output gear 32. FIG. 1 shows a position of the control gear 34 wherein it is meshed only with a first output gear 42. A distance separating the first 42 and second output gears 44 is larger than the length of the control gear 34 and therefore the control gear 34 may readily occupy a position (not shown) wherein it is meshed only with the second output gear 44. Since a distance separating a third output gear 46 from a fourth output gear 48 is also larger than the length of the control gear 34, the control gear may also occupy a position (not shown) wherein it is meshed only with the fourth output gear 48. The second 44 and third output gears 46 are separated from one another by a distance less than the length of the control gear 34. Therefore the control gear 34 may occupy a position shown on FIG. 2, wherein both of these gears are meshed with the control gear 34.

As is readily apparent from the above description, the drive gear 26 rotates the control gear 34. The latter rotates one or more of the output gears 32 dependent on its positioning relative to the fixedly positioned drive gear 38 or output gears 32. Any driven output gear 32, in turn, energizes a particular moving feature or function of the toy which is operatively associated therewith through a suitable connecting assembly (not shown). It should also be readily apparent from the above description that the actual number of output gears 32, and therefore the actual number of moving features or functions of the toy energized by each of the output gears 32 represents an optional design feature. Accordingly, the number and positioning of the output gears 32 specifically described here should be deemed to be examplary rather than limiting in nature.

Having described the selective driving of one of the output gears 32 dependent upon the relative positioning of the control gear 34, the ensuing description is directed towards an assembly which allows for a subjectively selected positioning of the control gear 34. Still referring to FIGS. 1 and 2, a control motor 50 incorporated within the housing 24, is disclosed. The control motor 50 is an electric motor which may be supplied with power from the same power source (not shown) as the drive motor 22. This power source (not shown) may comprise a plurality of batteries (not shown). In alternative embodiments of the control device 20 of the present invention the power source (not shown) may comprise the conventional 110 V household power supply.

The control motor 50, however unlike the drive motor 22, is not designed to act as a prime mover for the various moving features or functions of the toy and is therefore not necessarily energized while the toy is in operation. Instead, the control motor 50 is energized only as needed to fulfill its function in selectively positioning the control gear 34 at the option of a player or operator. The control motor 50 includes an output shaft 52 which is provided with a spur gear 54. The spur gear 54 of the output shaft 52 drives, through a second reducing gear assembly 56, a cam bearing gear 58. The second reducing gear assembly 56 includes first, second and third intermediate gears which respectively bear the reference numerals 60, 62 and 64. The intermediate gears 60, 62 and 64 are connected to one another according to established practice in the mechanical and toy manufacturing arts.

A cam member 66 comprising a cylindrical protrusion or stud is attached to an outside surface 68 of the cam bearing gear 58 in such a manner that a general longitudinal axis of the stud 66 is substantially parallel with the axis of rotation of the cam bearing gear 58. Consequently, as the cam bearing gear 58 rotates about its axis, the cam member 66 describes a circular path.

A cam follower connecting piece 70 is slideably mounted within the housing 24. In the first preferred embodiment described here, this is accomplished simply by providing a notch 72 on both sides of the housing 24, as is shown on FIGS. 1 and 2. A cover plate not shown on FIGS. 1 and 2 is attached by a plurality of screws (not shown) to the housing 24 to hold the intermediate gears 60, 62, 64 and the cam follower connecting piece 70 in position. A plurality of threaded apertures 74 are provided in the housing 24 for the receipt of the cover plate fastening screws (not shown).

The cam follower connecting piece 70 comprises a substantially rectangular base plate 76 from which a smaller substantially rectangular base plate 78 extends upwardly towards the control gear 34. A connecting portion 80 is attached orthogonally to the smaller rectangular plate 78. The connecting portion 80 includes two substantially parallel disposed ears or flanges 82 which interface with two lateral non-toothed sides 84 of the control gear 34.

The cam follower connecting piece 70 further includes a vertically disposed first slot 86 which slideably receives the cam member 66. A horizontally disposed second slot 88 is provided in the cam follower connecting piece 70 in order to slideably accommodate an axle 90 of the third intermediate gear 64.

As it was briefly mentioned above, the control motor 50 is energized only as needed to change the positioning of the control gear 34 whereby a desired moving feature or function of the toy is subjectively selected. It is readily apparent from the above description that the cam bearing gear 58 rotates when the control motor 50 is energized. This rotation causes lateral displacement of the cam follower connecting piece 70 and thereby a lateral displacement of the control gear 34.

The control motor 50 may be energized only for a relatively short predetermined period of time calculated to affect a predetermined lateral displacement of the control gear 34. The predetermined lateral displacement of the control gear 50 may be sufficient to move it out of meshing position with a selected output gear 32 such as e.g. the first output gear 42, and move it to mesh with e.g. the second output gear 44. It is apparent that a continuous running of the control motor 50 would result in an oscillating, sliding motion of the cam follower connecting piece 70 causing successive engagement and disengagement of each of the output gears 32.

The control motor 50 may be actuated for a requisite amount of time by various means. A simple on-and-off switch (not shown) to govern the control motor 50 may be provided on the toy. In this case a player may energize the control motor 50 by activating the switch (not shown) and may visually follow the change affected in the operation of the toy. As the desired moving function is activated the player simply may turn off the switch.

The control motor 50 may also be subjectively actuated by the player in the above described manner through an on-and-off switch located at the remote end of a flexible cable (not shown). In this case at least a limited remote control capability is achieved.

In more sophisticated embodiments of the control device 20 of the present invention, the control motor 50 is activated by a suitable electronic circuit which is responsive to a signal sent by a conventional signal source such as a small radio emitter. The signal source and the electronic circuit are respectively designated as signal sending means and signal receiving and control motor actuating means on FIGS. 1 and 2 and respectively bear the reference numerals 92 and 94.

In still other embodiments of the control device 20 of the present invention, the signal source 92 may be a source of sound signals. In such a case the electronic circuit comprising the signal receiving the control motor actuating means 94 includes a microphone which is selectively sensitive to the particular type of sound created by the signal source 92. As this can be readily understood by those skilled in the art, an electric impulse created by the microphone in response to the appropriate sound signal triggers the electronic circuit to energize the control motor 50.

In still further alternative embodiments of the control device 20 of the present invention, the electronic circuit may be adapted to actuate the control motor 50 for a predetermined time period only. As it was explained above, in such a case the control device 20 will switch the toy from one moving function to another in response to a single signal sent by the signal source 92. Electronic circuits which can accomplish the above described functions and corresponding signal sources may be readily constructed according to present skill in the electronic and related arts. Therefore, the actual circuits and the actual signal sources utilized in the present invention need not be disclosed here in detail.

As this was shown above, a significant advantage of the control device 20 of the present invention is that a plurality of functions of the toy may be controlled by a simple time limited actuation of a single control motor.

Referring now to the cross sectional view of FIG. 5 the mounting of the output gears 32 within the housing 24 is disclosed in detail. Each lateral side 96 of the housing 24 incorporates a sleeve 98 which projects inwardly toward the interior of the housing 24. The sleeves 98 act as bearings for a first 100 and second axle 102 each of which is rotatably mounted in a respective sleeve 98. The first 42 and fourth 48 output gears each include a sleeve type bearing respectively designated as 104 and 106. These are rotatably mounted upon the respective first 100 and second axles 102 so that the first 42 and fourth 48 output gears may rotate independently from the rotation of the axles 100 and 102. In order to drive a moving function of the toy, additional gears or like devices (not shown) are assembled to each of the first 42 and fourth 48 output gears.

The second 44 and third 46 output gears are fixedly mounted to the respective axles 100 and 102 so that the second gear 44 rotates the first axle 100 and the third gear 46 rotates the second axle 102. Each of these axles drive a respective moving function of the toy through an assembly (not shown) which is connected outside of the housing to the respective axles 100 and 102.

Figure 3:
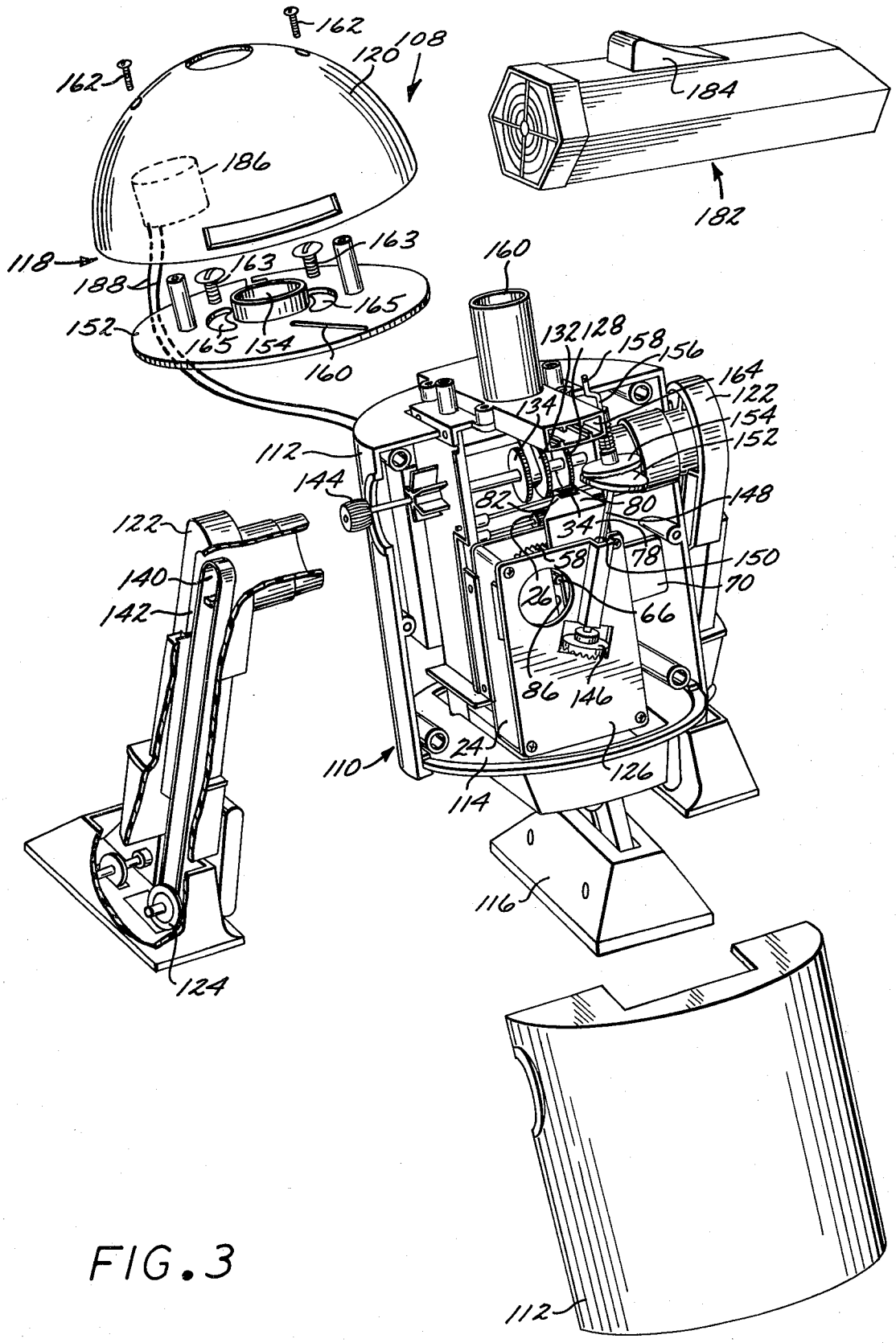
FIG. 3 is a partially exploded perspective view showing a toy robot embodying a second preferred embodiment of the control device of the present invention.

Referring now to FIGS. 3, 4 and 6 and more specifically to FIG. 3, a second preferred embodiment of the control device 20 of the present invention is disclosed.

The control device 20 is incorporated in a toy robot 108. Because the principal features of the control device 20 of the present invention have been disclosed in detail above, an ensuing description of the second preferred embodiment is less detailed.

The toy robot 108 includes a main housing 110 which comprises two complementary plastic shells 112 attached to one another by suitable means such as screws (not shown). The housing 24 of the control device 20 is located within the main housing 110 of the robot 108. The main housing 110 includes a lower shell member 114 to which a base leg member 116 is attached. The base leg member 116 incorporates a wheel (not shown) for rolling upon a support surface (not shown).

The robot 108 further includes a head simulating portion 118 which has a half spherical cover 120. A side limb appendage 122 is attached to either side of the main housing 110. Each side limb appendage includes a rotatable wheel 124 designed for driving the robot 108 along a support surface in a gait simulating a walking motion of a robot.

Referring now to FIG. 4, a drive motor 22 and a control motor 50 are disclosed. These are incorporated in the control device housing 24. Both the drive motor 22 and the control motor 50 are supplied with power by a plurality of batteries (not shown) which are incorporated in the toy robot 108.

A first reducing gear assembly 28 powered by the drive motor 22, drives a drive gear 26. The drive gear 26 is fixedly but rotatably mounted within the housing 24 upon an axle 38 which is transverse to the general longitudinal axis of the housing 24. An output shaft 52 of the control motor 50 drives a second reducing gear assembly 56 which is substantially identical to the second reducing gear assembly 56 of the first preferred embodiment. Neither the output shaft 52 nor the second reducing gear assembly 56 are shown on FIGS. 3 and 4 although a portion of a cam bearing gear 58 is shown on FIG. 3. The second reducing gear assembly 56 is disposed below a cover plate 126, shown on FIG. 3.

The cam bearing gear 58 and a cam follower connecting piece 70, best shown on FIG. 3, are identical in construction with the like parts of the first preferred embodiment. The cam follower connecting piece 70 here, as in the first preferred embodiment, is capable of laterally positioning a control gear 34 which is permanently meshed with the drive gear 26. The control gear 34 is mounted upon an axle 36 which is rotatable and laterally movable relative to the housing 24, as is described for the first preferred embodiment.

In the second preferred embodiment of the control device 20 disclosed here, three output gears 32 are provided. These are best shown on FIG. 4. In close analogy to the mounting of the output gears 32 in the first preferred embodiment, a first output gear 128 of the second preferred embodiment rotates freely upon a first axle 130. A second output gear 132 of the second preferred embodiment rotates together with the first axle 130, and the third output gear 134 rotates together with a second axle 136. A portion 137 of the housing 24 which provides reinforcement to the axles 130 and 136 is broken away on FIG. 4. The second 132 and third 134 output gears each drive the respective side limb appendage 122. The first output gear 128 drives a toy projectile launching assembly 138 which is described in detail further below.

The three output gears 128, 132 and 134 are positioned relative to one another in such a manner that each of them may individually mesh with the control gear 34. In addition, both the second 132 and third 134 output gears may simultaneously mesh with the control gear 34.

Referring again to FIG. 3 the operation of the side limb appendages 122 is disclosed. An endless belt 140 is disposed in a cavity 142 provided in each side limb appendage 122. The endless belt 140 engages a friction cylinder 144 provided at an end of the respective first 130 and second 136 axles. It also engages the respective wheels 124. Thus the second 132 and third 134 output gears drive the side limb appendages 122.

Still referring to the partially exploded view of FIG. 3, an additional moving feature of the toy robot 108 is disclosed. This moving feature or function is driven by the control motor 50 and is therefore actuated in every instance when the control motor 50 is energized. A spur gear (not shown) is included on a second intermediate gear 62 of the second reducing gear assembly 56. The second intermediate gear 62 although not shown in the second preferred embodiment, is well illustrated in FIGS. 1 and 2 for the first preferred embodiment. Thus spur gear (not shown) is permanently meshed with a crown gear 146 which is located at one end of a shaft 148. The shaft 148 is rotatably held within a channel 150 provided in the cover plate 126. A wheel 152 composed of rubber or like high friction material is attached to a second end of the shaft 148. A spring biased second wheel 154 is frictionally engaged with the rubber wheel 152. The second wheel drives a substantially vertically disposed axle 156 rotatably held in the toy robot housing 110. The axle 156 terminates in a crank 158.

The housing 110 includes a hollow tubular member 160 extending upwardly into the head simulating portion 118. A circular, substantially flat plate 152 is pivotably mounted upon the tubular member 150 through an aperture 154 which is dimensioned to accommodate the tubular member 150. A slot 160 is provided in the circular plate 152. In the assembled robot 108 the crank 158 is inserted into the slot 160 and the half spherical cover 120 is fixedly attached to the circular plate 152 by screws 162. The circular path 162, in turn, is attached to the housing 110 by long headed screws 163 which are accomodated in curved slots 165.

It is readily apparent from the above description that rotation of the control motor 150 causes a rotary motion of the crank 158. This, in turn, results in an oscillating angular motion of the circular plate 152 and therefore of the half spherical cover 120. The angular motion of the half spherical cover 120 effectively simulates a head shaking motion. Thus, each time the control motor 50 is turned on in order to affect a change in the operational status of the robot 108, the robot 108 shakes its head.

Referring now to FIGS. 3, 4 and 6, and particularly to the cross sectional view of 6, the operation of the toy projectile launching assembly 138 is disclosed in detail.

A substantially horizontally disposed channel 164 is incorporated in the robot housing 110 just below the head simulating portion 118. The channel 164 is in communication with the hollow tubular member 150, as is shown on FIG. 6. The robot housing 110 has a relatively narrow opening or slot 166 allowing communication of the channel 164 with the inside of the control device housing 24. A plate 168 is slideably mounted within the channel 164 and is biased by a coil spring 170 towards an opening of the channel 164. A pair of protrusions (not shown) provided in the inside walls of the channel 164 restrict a forward movement of the plate 168 and prevent the plate 168 from falling out of the channel 164.

The hollow tubular member 150 is adapted to receive a plurality of disc shaped toy projectiles 172, shown on FIG. 6. In its spring biased resting position the plate 168 is disposed below the tubular member 150 supporting the disc shaped projectiles 172. The first output gear 128 is permanently meshed with a gear 174 fixedly mounted to an axle 176 which bears a lever shaped member 178. The gear 174 and the axle 176 are disposed above the first output gear 128, as is shown on FIG. 4.

The lever shaped member 178 which rotates together with the gear 174 terminates in a hook shaped protrusion 180 which interfaces with the plate 168. It is readily apparent from the above description that as the gear 174 rotates, the hook shaped protrusion 180 forces the plate 168 to move backwards against the bias of the spring 170. A disc shaped projectile 174 then falls into the channel 164 and is ejected therefrom when the plate 168 is rapidly pushed forward by the force of the spring 170. The above described toy projectile launching assembly 138 comprises an example of a moving feature or function of the toy which is driven by the drive motor 22 and may be selectively actuated through the control device 20 of the present invention.

Referring now to FIG. 3, a sound wave actuated remote control feature of the second preferred embodiment of the control device 20 of the present invention is explained. The drive motor 22 is actuated by a conventional on-and-off switch (not shown) located on the robot housing 110. A sound making assembly 182 which comprises the signal sending means 92 schematically shown on FIGS. 1 and 2, is provided. The sound making assembly 182 is capable of producing a relatively high pitched clicking or snapping sound. Such a sound making assembly may be readily manufactured according to standard practice in the toy manufacturing and related arts and therefore need not be described in detail. The high pitched clicking sound is produced when a player vigorously depressed an actuating lever 184 shown on FIG. 3.

A microphone 186 is incorporated in the head simulating portion 118 just below the half-spherical cover 120. The microphone 186 is sensitive to the clicking sound produced by the sound making assembly and provides an electrical impulse in response thereto. The electrical impulse is transmitted through wires 188 to an electronic circuit (not shown) which together with the microphone 186 comprises the signal receiving means 94 schematically shown on FIGS. 1 and 2. The electronic circuit triggers the operation of the control motor 50 in response to the electric impulse sent by the microphone 186.

After a desired moving appendage or function has been actuated, the player may deactivate the control motor 50 by producing another clocking sound with the sound making assembly 182. The electronic circuit (not shown) is adapted to deenergize the control motor 50 in response to this second sound signal received through the microphone 186. The electroic circuit (not shown) may be readily designed according to established practice in the electronic and related arts, and therefore need not be disclosed here in detail.

The various optional play features of the toy robot 108 equipped with the control device 20 of the present invention are readily apparent in light of the above description. A player may actuate the operation of side limb appendages 122 to cause a walk simulating motion of the robot 108. The player at his option may activate only one of the side limb appendages 122 thereby causing the robot 108 to turn, or the player may altogether stop the robot 108 without turning off the drive motor 22. The player, at his option, may activate the projectile launching assembly 138 causing the rotor 108 to successively eject disc shaped toy projectiles 172 from its head. Moreover, each time the control motor 50 is activated the robot 108 shakes its head.

Various modifications of the control device 20 of the present invention and of the toy robot 108 incorporating the same, may be readily apparent to those skilled in the arts. Accordingly, the scope of the present invention should be interpreted solely from the following claims.

What is claimed is:

1. In a toy having a plurality of moving parts, and a device for driving and selectively actuating any one of the parts, the device comprising:

a drive motor mounted within the toy, the drive motor rotating a drive gear mounted upon a first axle;

a control gear mounted upon a second axle in the toy and engaging the drive gear, the control gear being movable relative to the drive gear in a direction parallel with the first axle while staying in operative position wherein the drive gear rotates the control gear;

a plurality of output gears, each output gear being fixedly positioned relative to the drive gear for engagement with the control gear in at least one subjectively selected position of the control gear, each output gear driving a predetermined part of the toy;

cam means for continuously moving the control gear relative to the drive gear, the cam means including a cam member and a cam follower connecting piece mounted for movement in the toy parallel with the first axle, the connecting piece moving the control gear, and motor means for driving the cam means, for as long as the motor means are energized the motor means being subjectively actuable by an operator, the cam means and the control gear being adapted to be left in any position that the cam means and the control gear are occupying at the time the motor means are deenergized.

2. The device of claim 1 further including signal sending and signal receiving means, the sending means being adapted for sending a signal to the receiving means, the receiving means being adapted for energizing the motor means in response to the signal.

3. The device of claim 2 wherein the sending and receiving means are adapted for respectively sending and receiving a sound signal.

4. The device of claim 2 wherein the sending means are physically separated from the toy.

5. The device of claim 2 wherein the toy is a toy robot having at least two leg members, each leg member incorporates an endless track driving a wheel and engaging one of the output gears, whereby each wheel may be selectively actuated at an option of the operator.

6. The device of claim 5 wherein the toy robot further includes toy projectile ejecting means operatively connected to one of the output gears whereby the top projectile ejecting means may be selectively actuated by the operator.

7. In a toy having a plurality of functions involving motion, each of the functions being energized by a drive motor through a respective rotatable output gear, a control device for subjectively actuating any of the functions of the toy, the control device comprising:

a drive gear rotated by the drive motor, a control gear mounted on a first axle for variable positioning relative to the drive gear, the control gear operatively engaging the drive gear and capble of being selectively engaging and driving each of the output gears, the individual output gear engaged by the control gear being dependent on the positioning of the control gear relative to the drive gear;

a selectively actuable control motor;

first means driven by the control motor for continuously sliding the control gear on the axle whereby the control gear successively engages and disengages each of the output gears, the first means and the control motor being adapted for leaving the control gear in any position occupied by the control gear at the time the control motor is deenergized;

signal receiving means for receiving a signal sent by an operator at his option and for energizing the control motor in response to the signal, and signal sending means for actuating the signal receiving means.

8. The device of claim 7 wherein the signal receiving means actuate the control motor for a predetermined period of time in response to a signal.

9. The device of claim 7 wherein the signal is a sound signal.

10. The device of claim 7, wherein the drive gear is mounted upon a second axle, the first and second axles are parallel, the control gear is in permanent engagement with the drive gear and is movable relative thereto in a direction defined by the first and second axles.

11. The device of claim 10 wherein each output gear is mounted upon an axle parallel with the first axle.

12. The device of claim 10 wherein the first means include a cam rotated by the control motor and a cam follower operatively connected to the cam, the cam follower engaging and moving the control gear in the direction defined by the first axle.

13. The device of claim 10 wherein the toy includes two side limb appendages, each side limb appendage comprising means selectively driven by the drive gear for moving the toy along a support surface.

14. The device of claim 10 wherein the toy further includes means for launching toy projectiles, the means being selectively driven by the drive gear.

15. A toy robot comprising:

a base member;

a drive motor mounted within the base member for rotating a drive gear mounted upon a first axle;

a control gear mounted upon a second axle within the base member, the control gear being freely movable relative to the drive gear in a direction parallel with the first axle to occupy a plurality of subjectively selected operative positions wherein the drive gear rotates the control gear;

at least three output gears mounted within the base member, each output gear being fixedly positioned relative to the drive gear for engagement with the control gear in at least one subjectively selected operative position of the control gear, each output gear driving a predetermined part of the toy robot;

cam means mounted within the base member for continuously moving the control gear relative to the drive gear, the cam means including a cam member and a cam follower connecting piece mounted for lateral movement in the base member parallel with the first axle, the connecting piece carrying the control gear;

control motor means mounted within the base member for driving the cam means for as long as the control motor means are energized, the cam means and the control gear being adapted to be left in any position that the cam means and the control gear are occupying at the time the control motor means are deenergized;

signal sending means remote from the base member for sending a signal at the option of a player;

signal receiving means mounted within the toy robot for receiving the signal and energizing the control motor means in response thereto;

at least two side appandages mounted to the base member, each appandage having roller means for propelling the toy robot on a support surface, one of the three output gears being operatively connected to and driving each roller means;

a cover member pivotably mounted on top of the base member and simulating a head of the toy robot, and means driven by the control means motor for moving the cover member in an oscillating pivoting motion relative to the base member each time the control motor is energized, the oscillating pivoting motion effectively simulating the toy robot shaking its head.

16. The invention of claim 15 further comprising means for launching toy projectiles mounted to the base member and driven by a third of the three output gears.

17. The invention of claim 16 wherein the signal sending means are sound signal sending means.

* * * * *